US007250133B2

(12) United States Patent
Berglund et al.

(10) Patent No.: US 7,250,133 B2
(45) Date of Patent: Jul. 31, 2007

(54) DEVICE FOR USE WHEN HARDENING

(75) Inventors: Göran Berglund, Gammelstad (SE); Mats Lindberg, Luleå (SE)

(73) Assignee: Accra Teknik AB, Ojebyn (SE)

( * ) Notice: Subject to any disclaimer, the term of this patent is extended or adjusted under 35 U.S.C. 154(b) by 50 days.

(21) Appl. No.: 10/505,683

(22) PCT Filed: Feb. 5, 2003

(86) PCT No.: PCT/SE03/00190

§ 371 (c)(1),
(2), (4) Date: Oct. 4, 2004

(87) PCT Pub. No.: WO03/072842

PCT Pub. Date: Sep. 4, 2003

(65) Prior Publication Data

US 2005/0127583 A1 Jun. 16, 2005

(30) Foreign Application Priority Data

Feb. 28, 2002 (SE) ..... 0200609

(51) Int. Cl.
*C21D 1/62* (2006.01)

(52) U.S. Cl. ..... 266/117; 266/260

(58) Field of Classification Search ..... 266/260, 266/274, 117; 148/646; 432/261
See application file for complete search history.

(56) References Cited

U.S. PATENT DOCUMENTS

| | | | | |
|---|---|---|---|---|
| 17,172 | A * | 4/1857 | Seymour | 266/260 |
| 1,429,138 | A * | 9/1922 | Harry | 266/260 |
| 1,600,266 | A * | 9/1926 | Armstrong | 266/274 |
| 5,401,006 | A | 3/1995 | Canner | |
| 6,210,500 | B1 * | 4/2001 | Zurfluh | 148/646 |

* cited by examiner

*Primary Examiner*—Scott Kastler
(74) *Attorney, Agent, or Firm*—Ware, Fressola, Van der Sluys & Adolphson LLP

(57) ABSTRACT

A device for use when hardening includes fixture parts (1, 4, 6) between which a workpiece is fixed during hardening. The device's fixture parts (1, 4, 6) are three or more so that two or more workpieces are fixed simultaneously in the device.

15 Claims, 2 Drawing Sheets

DEVICE FOR USE WHEN HARDENING

BACKGROUND OF THE INVENTION

1. Technical Field

This invention concerns a device for use when hardening workpieces.

2. Description of the Background Art

At present, many structural articles and products are manufactured in the form of or based on components, articles and/or blanks that are manufactured in material that can be processed and shaped in different ways and thereafter hardened by heating and subsequent quenching. The material used is mainly iron and steel alloy or other metals.

Previously known are devices to be used for hardening components comprising an upper fixture part and a lower fixture part. These parts can be moved towards and away from each other and are provided with means for cooling. A formed workpiece is placed between these two fixture parts. The workpiece can be heated before being placed between the fixture pieces. Alternatively, the workpiece can be heated after being placed between the fixture pieces. The two fixture parts are subsequently moved towards each other and through the delivery of a coolant, for example water, via the means for cooling in the fixture parts, the component located between the fixture parts is quenched. The principal object of this measure is to stabilize the shape of the component and reduce the need of subsequent reworking of products that have been hardened while improving the precision with regard to form and dimension.

Previously well known are devices where the workpiece is also shaped through pressing when the upper fixture part and the lower fixture part are moved towards each other before hardening takes place.

The manufacture of components and products comprising a number of stages, for example forming, hardening and subsequent working and adjustment, is often a question of striking a balance between the requirement of high quality of each product with the requirement of low cost. Development has long been concentrated on quality improvements. As competition increases, however, development must be directed more towards economizing.

SUMMARY OF THE INVENTION

The object of this invention is to offer a device for use when hardening components that eases this balancing and further improve, streamline and cut the cost of manufacture.

This object is achieved with a device according to this invention having fixture parts between which a workpiece is fixed while hardening. There are at least three fixture parts so that at least two workpieces can be fixed simultaneously in the device. At least two of the fixture parts are adjustable to move toward and away from a common stationary fixture part.

The invention offers a device in which several previously formed workpieces can be hardened simultaneously, or an alternative device in which several workpieces can be formed and hardened simultaneously. The device is designed as a cartridge unit with more than two fixture bodies between which workpieces are placed and positioned for fixing during a hardening process or alternatively a forming and hardening process.

BRIEF DESCRIPTION OF THE DRAWINGS

The invention will be described below with references made to an embodiment of the device and attached figures.

DETAILED DESCRIPTION OF THE INVENTION

Figure 1:
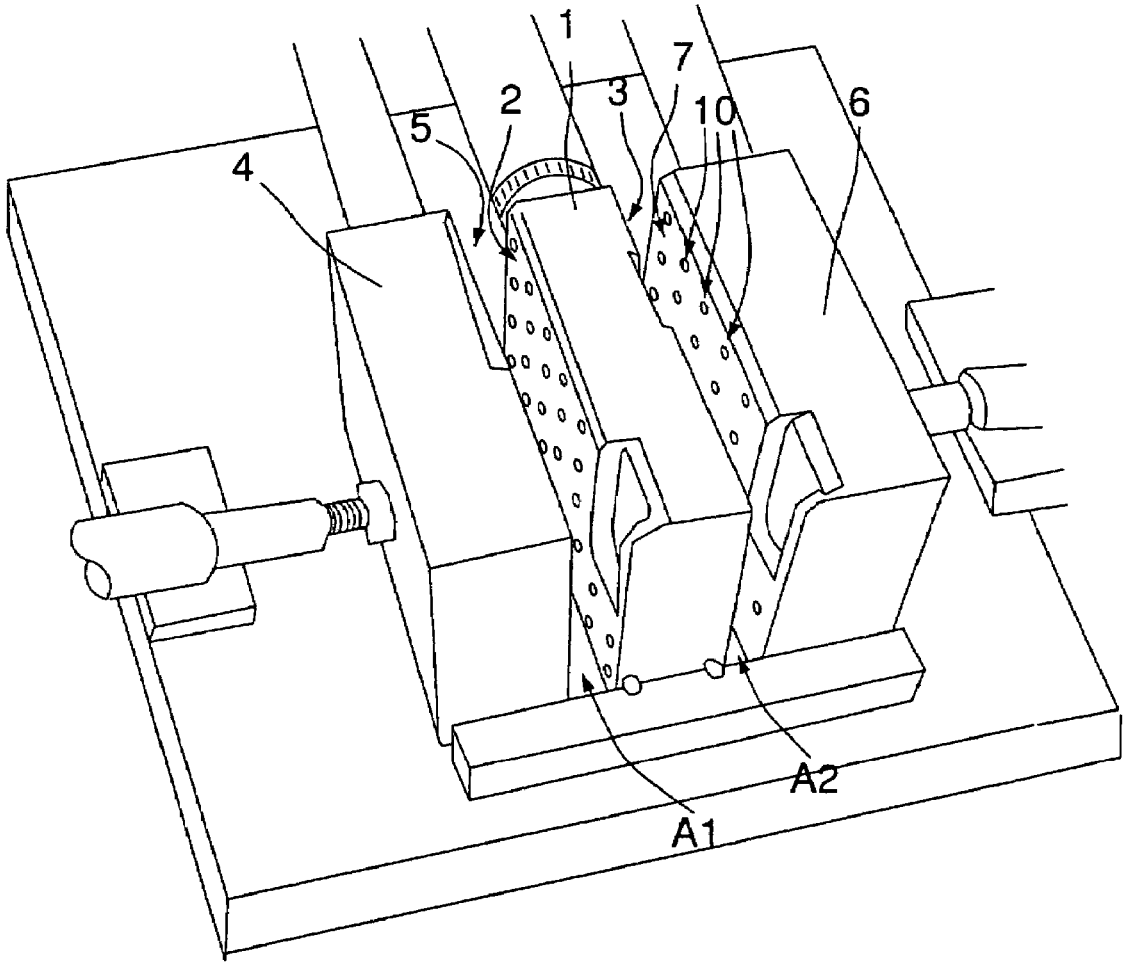
FIG. 1 shows a device according to the invention in a perspective view where the device's fixture parts are separated so that the device can receive two workpieces.
Figure 2:
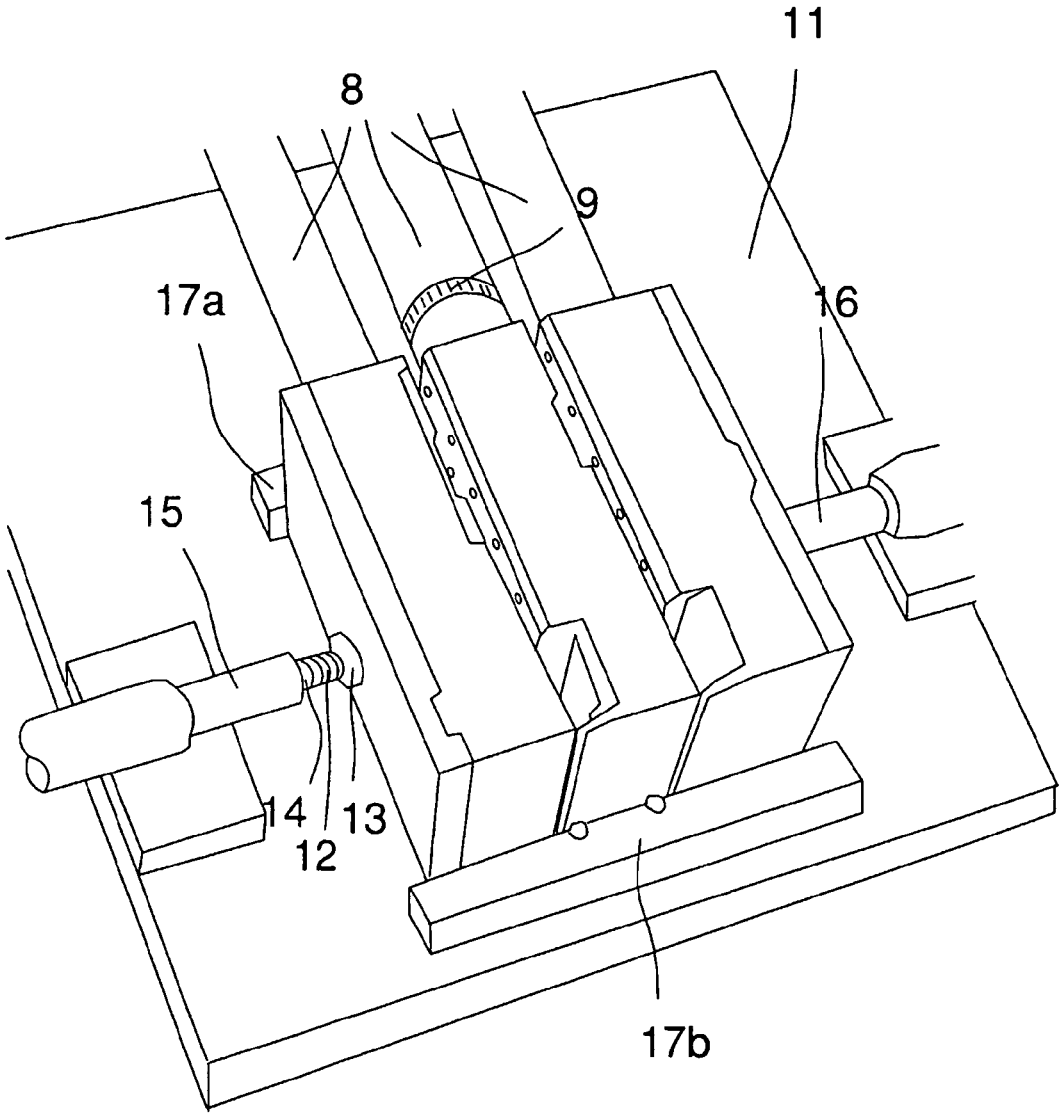
FIG. 2 shows the device according to the invention in a perspective view where the device's fixture parts are brought against each other to a position where the device fixes the position of two workpieces (not shown).

The device comprises a first fixture part 1 with two working faces 2 and 3. The working faces 2 and 3 comprise two opposing sides of fixture part 1.

The device further comprises a second fixture part 4 that also has a working face 5. Working face 5 comprises one side of the second fixture part 4. The second fixture part 4 can be moved to and from the first fixture part 1.

The device comprises also a third fixture part 6. The third fixture part 6 has a similar working face 7. Working face 7 comprises one side of the third fixture part 6. The third fixture part 6 can also be moved to and from the first fixture part 1.

The device comprises and is connected to means and components that allow cooling of the working faces and workpieces. Coolant is conveyed in passages to each workpiece and is distributed over the same to cool the working faces of the tool and the workpiece placed between the working faces being hardened. Each fixture part is connected to a coolant reservoir (not shown). The coolant is conveyed in pipes/lines 8 from the coolant reservoir to each fixture part 1, 4 and 6 through each fixture part 1, 4 and 6 and further to each working face 2, 3, 5 and 7. Means of coupling 9 connect each fixture part 1, 4 and 6 to at least one pipe/line 8. The fixture parts 1, 4 and 6 are internally provided with passages (not shown) through which the coolant is conveyed. The passages lead to openings 10 in the work faces, well distributed and spread over the faces. The coolant can be water, for example.

The three fixture parts 1, 4 and 6 are placed adjacent to each other. They are placed in a horizontal plane on a supporting part, a bottom plate 11. The bottom plate 11 supports the entire device with all its components. Fixture parts 1, 4 and 6 are so arranged that the working faces 2, 3, 5 and 7 are principally positioned vertically. The first fixture part 1 is located in between the two movable fixture parts 4 and 6. One of the working faces 2 on the first fixture part 1 is directed towards and interacts with working face 5 on the second fixture part 4. Another working face 3 on the first fixture part 1 is directed towards and interacts with working face 7 on the third fixture part 6.

The first fixture part 1 is stationary and fixed to the bottom plate 11. It can be welded on, for example. The second 4 and third 6 fixture parts are adjustably arranged on each side of the first fixture part 1. Fixture parts 4 and 6 interact with and are moved using a means for moving/positioning. The moving means comprises two threaded rods 12 (one only shown). One of the rods 12 is at one end 13 fastened to the second fixture part 4, which is adjustable. The rod 12 is fastened to the side of fixture part 4 that is principally in the opposite direction to its working face 5. The other end 14 of the rod interacts with an energy conveying part 15 and is inserted into a hole in the energy conveying part 15. The hole has an internal thread that interacts with the external thread on the rod. When a part, the part comprising the hole, of the energy conveying part 15 is rotated, the rod 12 is displaced relative to the energy conveying part 15 and the adjustable fixture part 4 is thereby brought towards/away from the first fixture part 1 depending on the direction of rotation. The energy conveying part 15 is rotated using a motor (not shown). Correspondingly, the second rod is mounted on the second adjustable fixture part 6 and interacts with a second energy conveying part 16. For fast handling of the device, the two fixture parts 4 and 6 are activated and moved simultaneously.

The fixture parts 4 and 6 are moved principally perpendicular to the first fixture part 1, linearly along the upper face of the bottom plate 11. Fixture parts 1, 4 and 6 interact with a guide/control means, a guide system. The second 4 and third 6 fixture parts run in the guide system, which comprises two parallel tracks 17*a* and 17*b* that guide the adjustable fixture parts 4 and 6 to prevent the movement of the two parts 4 and 6 in another direct than towards/away from the first fixture part 1. The guides 17*a* and 17*b* are mounted on the bottom plate 11 and placed on each side of the fixture parts 1, 4 and 6. The guides 17*a* and 17*b* can also be called bed tracks. The bottom plate 11 constitutes also part of the guide means as it guides the bottom of the fixture parts 4 and 6.

Working faces 2, 3, 5 and 7 have been adapted to and shaped for the components that are to be hardened in the device. Each working face 2, 3, 5 and 7 can be made directly in the body constituting the tool part 1, 4 and 6 itself or one or more working faces can each be made in another material body that is later arranged against, fastened to, the working side of the fixture part. If the working faces are designed so that they can be replaced, this will facilitate the use of the same device for hardening workpieces of different shapes.

Pairs of working faces 2, 3, 5 and 7 contain in two opposing directions the spaces A1 and A2 that arise between the two opposing working faces 2 and 5 respectively 3 and 7, between two adjacent fixture bodies 1 and 4, and 1 and 6 respectively. Spaces A1 and A2 are contained in a third direction by the bottom plate 11. The size of each space A1 and A2 can through the movement of one adjustable fixture part 4 or 6 and thereby one working face 5 or 7 away from the fixed fixture part 1 be adjusted so that the space A1 or A2 becomes large enough to hold a workpiece in the space. One adjustable fixture part 4 or 6, and thereby one working face 5 or 7, is then moved in a direction towards the fixed fixture part 1 until the space corresponds in form and volume to the form and volume of the workpiece. This adjustment makes it possible to vary the form tolerances and adapt the device to various material thicknesses and workpieces with different volumes.

When the fixture parts 4 and 6 have been given their desired positions and volume of the spaces A1 and A2 respectively, they are locked in their respective positions. Locking can be achieved by putting the drive motor in neutral or turning it off.

The device can comprise and be connected to devices and parts that make it possible to heat the working faces and thereby the workpieces (not shown). This can be necessary if the workpieces are to be heated to austenitizing temperature while they are in place in the device or if they are to be formed in the device.

If the workpieces are also to be formed in the device, the working faces 2, 3, 5 and 7 have been adapted to and formed for the work to be done in the device. Even the moving means and the guiding means are then adapted to the forming being done and are of such a type that the fixture parts can be brought together in such a way and with such a force that the workpieces are formed. Forming can constitute a type of form pressing.

Fixture parts 1, 4 and 6, their working faces 2, 3, 5 and 7, and the bottom plate 11 are manufactured in a metal material that can be machined to a form corresponding to the workpieces or that can form blanks. The material must withstand being heated by hot workpieces while the device is in use and subsequent cooling by a coolant, or being heated ahead of forming the blanks and/or heating the workpieces to austenitizing temperature. The fixture parts must be manufactured in a metal material that is also shape permanent and can withstand alternate heating/cooling. The device can be adapted so that more than two workpieces can be hardened or formed and hardened at one time in the device. More adjustable fixture parts can be added to the design. The device's moving means and its control means may require revision and adaptation if the number of fixture parts is increased.

The fixture parts can be adapted to receive more than one workpiece in each space A1 or A2. This modification may also involve the need to revise and adapt the device's moving means and its guiding means. Also pneumatic and hydraulic devices or other types of transmission can be used as a moving means. The control means can also be designed in another way, such as through interacting parts of the plate and the fixture parts respectively.

A device according to the invention is used in the following way: Firstly, the formed workpieces are heated three-dimensionally to austenitising temperature. Each workpiece is subsequently placed in a space A1 and A2 between the fixture parts. The adjustable fixture parts 4 and 6 of the device are moved towards the fixed fixture part 1 and are locked in a suitable position. The locking position is predetermined or can be adapted so that best position is obtained at that moment. Fixture parts 1, 4 and 6 then offer, in combination, a fixed position of the workpieces. It would be suitable if all the fixture parts are moved simultaneously so that all the components are fixed in one and the same locking motion. This would minimize the time taken for locking. When the workpieces are fixed in position between the fixture parts 1, 4 and 6, a coolant is added through the openings 10, whereby the workpieces are cooled and hardened in the device.

The workpieces can alternatively be heated to austenitizing temperature when they are placed and fixed between the device's fixture parts 1, 4 and 6, and subsequently cooled and thereby hardened in the same device.

If the forming of workpieces and/or heating of workpieces to austenitizing temperature are to take place in the device, these steps will not constitute freestanding stations but are integrated in the device. In this case, the device is adapted so that the workpieces can also be formed in the device and the process will then start with non-formed blanks being placed in the device, formed and subsequently heated to austenitizing temperature. The fixture parts have then already assumed their locked positions after forming or, alternatively, after heating to austenitizing temperature.

A device according to the invention will suitably constitute part of a manufacturing process, one part of a production line. This device will then be preceded, unless the forming stage is integrated in the hardening device, for example, by a material handling station where the blanks are extracted and passed on to one or more forming stations where the blanks are fomled and become the formed workpieces. After this, a heating station can follow where the workpieces are heated to austenitizing temperature and finally placed in a device according to the invention.

A device according to the invention is suitable for use in mass production of three dimensionally formed components made of metal material. Hardening of small objects is facilitated and the device is, by means of its construction, easy to feed with workpieces and it is also easy to access and lift away the hardened components in that the spaces are open at the top and to a greater degree even at the side. It is easy to handle the workpieces both if the device is operated manually and if it is automated and interacts with a robot. Even if one of the sides should be closed, for example due to another design of the moving means or the guiding means, it is still possible to have one of the sides of spaces A1 and A2 open.

As more than one workpiece can be hardened (formed and hardened) in each sequence, the production rate can be at least doubled without having to lower standards of quality.

The need for subsequent reworking of the products that have been both formed and hardened in the same device is reduced while the precision regarding form and dimensions is improved. The number of times the workpiece is moved between various devices is also reduced as two or more different productions stages can be carried out in the same device, which in turn means that the manufacturing time is reduced.

This description of the invention is not to be regarded as a limitation but only as an example to facilitate comprehension of the invention. Adaptations of different parts in relation to other component parts, choice of material, size adjustments, shape adjustments, replacement parts and articles and everything else that is evident or presents itself immediately to a technical specialist can naturally be carried out within the idea of the invention.

The invention claimed is:

1. Device for use when hardening comprising at least three fixture parts between which at least two work pieces can be fixed simultaneously in the device while hardening, at least two of the fixture parts are moveable and one of the fixture parts is a common stationary fixture part, the moveable fixture parts can be moved towards and away from the common stationary fixture part, at least one of the moveable fixture parts being located on each side of the common stationary fixture part, and means for moving the moveable fixture parts, the moving means comprises components that convert a rotating motion to a linear motion for linear movement of at least one of the moveable fixture parts.

2. Device according to claim 1, wherein each fixture part cooperates with at least an adjacent one of the fixture parts for fixing at least one work piece.

3. Device according to claim 1, wherein the fixture parts are located parallel to each other.

4. Device according to claim 1, wherein each fixture part has at least one working face and each working face cooperates with the opposing working face of an adjacent one of the fixture parts for fixing at least one work piece.

5. Device according to claim 4, wherein at least one working face is formed in each fixture part.

6. Device according to claim 4, wherein each fixture part has two separate body sections, one body section is provided with the at least one working face and is releasably joined to the other body section.

7. Device according to claim 4, wherein each working face is principally arranged in a vertical plane.

8. Device according to claim 1, further comprising means for cooling each work piece fixed in the device.

9. Device according to claim 1, further comprising means for conveying coolant from a coolant reservoir to each fixture part and over each work piece for cooling the same.

10. Device according to claim 9, wherein the means for conveying coolant comprises lines from the coolant reservoir to each fixture part and associated means of coupling, passages defined in each fixture part for the passage of coolant and openings defined in working faces of the fixture parts in communication with the passages and through which the coolant passes.

11. Device according to claim 1, wherein each fixture part is connected to means for generating heat, the heat generating means comprises heating components for heating each work piece so that each work piece can be heated to at least one of a forming temperature and an austenitizing temperature.

12. Device according to claim 1, wherein the moving means acts on the moveable fixture parts in such a way that the moveable fixture parts can be brought to move towards and away from each other and the common stationary fixture part.

13. Device according to claim 1, wherein the components comprise a threaded rod fastened to at least one of the moveable fixture parts and interacting with an internally threaded part that, when it is rotated, exerts a linear motion on the rod.

14. Device according to claim 1, further comprising means of guiding movement of the moveable fixture parts relative to each other and common stationary fixture part.

15. Device according to claim 14, wherein the guiding means comprises two tracks situated on each side of the moveable fixture parts and mounted on a bottom plate, the bottom plate guides the moveable fixture parts in a horizontal plane.

* * * * *